US010149495B2

(12) United States Patent
Mironov

(10) Patent No.: US 10,149,495 B2
(45) **Date of Patent: *Dec. 11, 2018**

(54) SMOKING ARTICLE WITH IMPROVED AIRFLOW

(71) Applicant: Philip Morris Products S.A., Neuchatel (CH)

(72) Inventor: Oleg Mironov, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 344 days.

This patent is subject to a terminal disclaimer.

(21) Appl. No.: 14/377,381

(22) PCT Filed: Feb. 12, 2013

(86) PCT No.: PCT/EP2013/052792

§ 371 (c)(1),
(2) Date: Aug. 7, 2014

(87) PCT Pub. No.: WO2013/120854

PCT Pub. Date: Aug. 22, 2013

(65) Prior Publication Data

US 2015/0013697 A1 Jan. 15, 2015

(30) Foreign Application Priority Data

Feb. 13, 2012 (EP) ..... 12155238

(51) Int. Cl.
*A24F 47/00* (2006.01)
*A24B 15/16* (2006.01)

(52) U.S. Cl.
CPC ..... *A24F 47/006* (2013.01); *A24B 15/165* (2013.01); *A24F 47/008* (2013.01)

(58) Field of Classification Search
CPC ..... A24F 1/16; A24F 47/004; A24F 47/006
See application file for complete search history.

(56) References Cited

U.S. PATENT DOCUMENTS 4,793,365 A * 12/1988 Sensabaugh, Jr. ... A24B 15/165 131/194
4,819,665 A * 4/1989 Roberts ..... A24F 47/004 131/194

(Continued)

FOREIGN PATENT DOCUMENTS

CN 88 1 00383 A 8/1988
CN 1744833 A 3/2006

(Continued)

OTHER PUBLICATIONS

Combined Chinese Office Action and Search Report dated Apr. 20, 2016 in Patent Application No. 201380007051.0 (with English language translation).

(Continued)

*Primary Examiner* — Eric Yaary
(74) *Attorney, Agent, or Firm* — Oblon, McClelland, Maier & Neustadt, L.L.P.

(57) ABSTRACT

A smoking article having a mouth end and a distal end is provided, including a heat source; an aerosol-forming substrate downstream of the heat source; at least one air inlet downstream of the aerosol-forming substrate; and an airflow pathway extending between the at least one air inlet and the mouth end of the smoking article. The airflow pathway includes a first portion extending longitudinally upstream from the at least one air inlet towards the aerosol-forming substrate, and a second portion extending longitudinally downstream from the first portion to the mouth end of the smoking article.

30 Claims, 2 Drawing Sheets

(56) References Cited

U.S. PATENT DOCUMENTS

| | | | | |
|---|---|---|---|---|
| 5,040,551 | A | 8/1991 | Schlatter et al. | |
| 5,392,792 | A * | 2/1995 | Banerjee | A24D 3/045 131/336 |
| 5,708,258 | A | 1/1998 | Counts et al. | |
| 5,944,025 | A | 8/1999 | Cook et al. | |
| 6,164,287 | A * | 12/2000 | White | A24F 47/008 131/194 |
| 2004/0149296 | A1 | 8/2004 | Rostami et al. | |
| 2006/0070633 | A1 | 4/2006 | Rostami et al. | |
| 2007/0102013 | A1 | 5/2007 | Adams et al. | |
| 2009/0044818 | A1* | 2/2009 | Takeuchi | A24F 47/006 131/334 |
| 2009/0065011 | A1* | 3/2009 | Maeder | A24F 47/006 131/194 |
| 2009/0217933 | A1 | 9/2009 | Chen | |
| 2010/0083959 | A1 | 4/2010 | Siller | |
| 2010/0186757 | A1* | 7/2010 | Crooks | A24F 47/006 131/58 |
| 2011/0271972 | A1 | 11/2011 | Thomas et al. | |

FOREIGN PATENT DOCUMENTS

| | | | |
|---|---|---|---|
| CN | 101277623 | A | 10/2008 |
| CN | 101522063 | A | 9/2009 |
| CN | 201499602 | U | 6/2010 |
| DE | 199 35 706 | A1 | 2/2001 |
| DE | 10 2007 026 979 | | 4/2008 |
| EP | 0 277 519 | A2 | 8/1988 |
| EP | 0 295 122 | A2 | 12/1988 |
| EP | 0 371 285 | A2 | 6/1990 |
| EP | 0 430 559 | A2 | 6/1991 |
| JP | 62-48370 | A | 3/1987 |
| JP | 63-192372 | A | 8/1988 |
| JP | 3-232481 | A | 10/1991 |
| JP | H07-184627 | A | 7/1995 |
| JP | 2001-507576 | A | 6/2001 |
| JP | 2001-521123 | T | 11/2001 |
| JP | 2006-505281 | T | 2/2006 |
| JP | 2009-502136 | T | 1/2009 |
| JP | 2009-529871 | A | 8/2009 |
| JP | 2010-535530 | A | 11/2010 |
| JP | 2011-505874 | T | 3/2011 |
| WO | WO 99/20939 | A1 | 4/1999 |
| WO | WO 99/63844 | A1 | 12/1999 |
| WO | WO 2004/043175 | A1 | 5/2004 |
| WO | WO 2007/012007 | A2 | 1/2007 |
| WO | 2007 042941 | | 4/2007 |
| WO | WO 2007/108878 | A2 | 9/2007 |
| WO | WO 2007/119678 | A1 | 10/2007 |
| WO | WO 2009/022232 | A2 | 2/2009 |
| WO | WO 2009/074870 | A2 | 6/2009 |
| WO | WO 2009/079641 | A2 | 6/2009 |
| WO | WO 2012/014490 | A1 | 2/2012 |

OTHER PUBLICATIONS

International Search Report dated May 27, 2013 in PCT/EP13/052792 Filed Feb. 12, 2013.

Combined Office Action and Search Report dated Dec. 31, 2015 in Chinese Patent Application No. 201380007051.0 (with English language translation).

Office Action dated Jan. 4, 2017 in Japanese Patent Application No. 2014-556099 (with English language translation).

Chinese Office Action with English translation dated Aug. 31, 2017 in corresponding Chinese Patent Application No. 201380007051.0, (19 pages).

* cited by examiner

SMOKING ARTICLE WITH IMPROVED AIRFLOW

CROSS REFERENCE TO RELATED APPLICATION

This application is a national phase application based on PCT/EP2013/052792, filed on Feb. 12, 2013.

The present invention relates to a smoking article comprising a heat source and an aerosol-forming substrate downstream of the heat source.

A number of smoking articles in which tobacco is heated rather than combusted have been proposed in the art. One aim of such 'heated' smoking articles' is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by convection and conduction.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate. To provide a controlled amount of convective heating of the aerosol-forming substrate, at least one longitudinal airflow channel is provided through the combustible heat source.

In known heated smoking articles in which heat transfer from the heat source to the aerosol-forming substrate occurs primarily by convection, the convective heat transfer and hence the temperature in the aerosol-forming substrate can vary considerably depending upon the puffing behaviour of the user. As a result, the composition and hence the sensory properties of the mainstream aerosol inhaled by the user may be disadvantageously highly sensitive to a user's puffing regime.

In known heated smoking articles in which air drawn through the heated smoking article comes into direct contact with a combustible heat source of the heated smoking article, puffing by a user results in activation of combustion of the combustible heat source. Intense puffing regimes may therefore lead to sufficiently high convective heat transfer to cause spikes in the temperature of the aerosol-forming substrate, disadvantageously leading to pyrolysis and potentially even localised combustion of the aerosol-forming substrate. As used herein, the term 'spike' is used to describe a short-lived increase in the temperature of the aerosol-forming substrate.

The levels of undesirable pyrolytic and combustion by-products in the mainstream aerosols generated by such known heated smoking articles may also disadvantageously vary significantly depending upon the particular puffing regime adopted by the user.

There remains a need for a heated smoking article comprising a heat source and an aerosol-forming substrate downstream of the heat source in which spikes in the temperature of the aerosol-forming substrate are avoided under intense puffing regimes. In particular, there remains a need for a heated smoking article comprising a heat source and an aerosol-forming substrate downstream of the heat source in which substantially no combustion or pyrolysis of the aerosol-forming substrate occurs under intense puffing regimes.

According to the invention there is provided a smoking article having a mouth end and a distal end. The smoking article comprises: a heat source; an aerosol-forming substrate downstream of the heat source; at least one air inlet downstream of the aerosol-forming substrate; and an airflow pathway extending between the at least one air inlet and the mouth end of the smoking article. The airflow pathway comprises a first portion extending longitudinally upstream from the at least one air inlet towards the aerosol-forming substrate and a second portion extending longitudinally downstream from the first portion towards the mouth end of the smoking article.

In use, air is drawn into the first portion of the airflow pathway through the at least one air inlet. The drawn air passes upstream through the first portion of the airflow pathway towards the aerosol-forming substrate and then downstream towards the mouth end of the smoking article through the second portion of the airflow pathway.

According to the invention there is also provided a method of reducing or eliminating increases in temperature of an aerosol-forming substrate of a smoking article during puffing. The method comprises providing a smoking article comprising: a heat source; an aerosol-forming substrate downstream of the heat source; at least one air inlet downstream of the aerosol-forming substrate; and an airflow pathway extending between the at least one air inlet and the mouth end of the smoking article. The airflow pathway comprises a first portion extending longitudinally upstream from the at least one air inlet towards the aerosol-forming substrate and a second portion extending longitudinally downstream from the first portion towards the mouth end of the smoking article such that, in use, air drawn into the smoking article through the at least one air inlets passes upstream through the first portion of the airflow pathway towards the aerosol-forming substrate and then downstream towards the mouth end of the smoking article through the second portion of the airflow pathway.

As used herein, the term 'airflow pathway' is used to describe a route along which air may be drawn through the smoking article for inhalation by a user.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'front', and 'downstream' and 'rear', are used to describe the relative positions of components, or portions of components, of the smoking article in relation to the direction in which a user draws on the smoking article during use thereof. Smoking articles according to the invention comprise a mouth end and an opposed distal end. In use, a user draws on the mouth end of the smoking article. The mouth end is downstream of the distal end. The heat source is located at or proximate to the distal end.

As used herein, the term 'length' is used to describe the dimension in the longitudinal direction of the smoking article.

As used herein, the term 'isolated heat source' is used to describe a heat source that does not come into direct contact with air drawn through the smoking article along the airflow pathway.

As used herein, the term 'direct contact' is used to describe contact between air drawn through the smoking article along the airflow pathway and a surface of the heat source.

As described further below, smoking articles according to the invention may comprise heat sources that are blind or non-blind.

As used herein, the term 'blind' is used to describe a heat source of a smoking article according to the invention in which air drawn through the smoking article for inhalation by a user does not pass through any airflow channels along the heat source.

As used herein, the term 'non-blind' is used to describe a heat source of a smoking article according to the invention in which air drawn through the smoking article for inhalation by a user passes through one or more airflow channels along the heat source.

As used herein, the term 'airflow channel' is used to describe a channel extending along the length of a heat source through which air may be drawn downstream for inhalation by a user.

In accordance with the invention, during puffing by a user, cool air drawn through the at least one air inlet downstream of the aerosol-forming substrate and upstream through the first portion of the airflow pathway towards the aerosol-forming substrate advantageously reduces the temperature of the aerosol-forming substrate of smoking articles according to the invention. This substantially prevents or inhibits spikes in the temperature of the aerosol-forming substrate during puffing by a user.

As used herein, the term 'cool air' is used to describe ambient air that is not significantly heated by the heat source upon puffing by a user.

By preventing or inhibiting spikes in the temperature of the aerosol-forming substrate, the inclusion of an airflow pathway extending between at least one air inlet downstream of the aerosol-forming substrate and the mouth end of the smoking article, wherein the airflow pathway comprises a first portion extending longitudinally upstream from the at least one air inlet towards the aerosol-forming substrate and a second portion extending longitudinally downstream from the first portion towards the mouth end of the smoking article, advantageously helps to avoid or reduce combustion or pyrolysis of the aerosol-forming substrate of smoking articles according to the invention under intense puffing regimes. In addition, the inclusion of such an airflow pathway advantageously helps to minimise or reduce the impact of a user's puffing regime on the composition of the mainstream aerosol of smoking articles according to the invention.

Preferably, the first portion of the airflow pathway extends longitudinally upstream from the at least one air inlet to at least proximate the aerosol-forming substrate. More preferably, the first portion of the airflow pathway extends longitudinally upstream from the at least one air inlet to the aerosol-forming substrate.

Preferably, the second portion of the airflow pathway extends longitudinally downstream from at least proximate the aerosol-forming substrate towards the mouth end of the smoking article. More preferably, the second portion of the airflow pathway extends longitudinally downstream from the aerosol-forming substrate towards the mouth end of the smoking article.

In certain embodiments, the second portion of the airflow pathway may extend longitudinally downstream from within the aerosol-forming substrate towards the mouth end of the smoking article.

In one preferred embodiment, the first portion of the airflow pathway extends longitudinally upstream from the at least one air inlet to the aerosol-forming substrate and the second portion of the airflow pathway extends longitudinally downstream from the aerosol-forming substrate towards the mouth end of the smoking article.

In another preferred embodiment, the first portion of the airflow pathway extends longitudinally upstream from the at least one air inlet to the aerosol-forming substrate and the second portion of the airflow pathway extends longitudinally downstream from within the aerosol-forming substrate towards the mouth end of the smoking article.

In use, an aerosol is generated by the transfer of heat from the heat source to the aerosol-forming substrate of smoking articles according to the invention. By adjusting the position of the upstream end of the second portion of the airflow pathway relative to the aerosol-forming substrate, it is possible to control the location at which the aerosol exits the aerosol-forming substrate. This advantageously allows the smoking articles according to the invention to be produced having desired aerosol deliveries.

In preferred embodiments, air drawn into the first portion of the airflow pathway through the at least one air inlet passes upstream through the first portion of the airflow pathway to the aerosol-forming substrate, through the aerosol-forming substrate and then downstream towards the mouth end of the smoking article through the second portion of the airflow pathway.

In one preferred embodiment, the first portion of the airflow pathway and the second portion of the airflow pathway are concentric. However, it will be appreciated that in other embodiments the first portion of the airflow pathway and the second portion of the airflow pathway may be non-concentric. For example, the first portion of the airflow pathway and the second portion of the airflow pathway may be parallel and non-concentric.

Where the first portion of the airflow pathway and the second portion of the airflow pathway are concentric, preferably the first portion of the airflow pathway surrounds the second portion of the airflow pathway. However, it will be appreciated that in other embodiments the second portion of the airflow pathway may surround the first portion of the airflow pathway.

In one particularly preferred embodiment the first portion of the airflow pathway and the second portion of the airflow pathway are concentric, the second portion of the airflow pathway is disposed substantially centrally within the smoking article and the first portion of the airflow pathway surrounds the second portion of the airflow pathway. This arrangement is particularly advantageous where smoking articles according to the invention further comprise a heat-conducting element around and in direct contact with a rear portion of the heat source and an adjacent front portion of the aerosol-forming substrate.

The first portion of the airflow pathway and the second portion of the airflow pathway may be of substantially constant transverse cross-section. For example, where the first portion of the airflow pathway and the second portion of the airflow pathway are concentric, one of the first portion of the airflow pathway and the second portion of the airflow pathway may be of substantially constant circular cross-section and the other of the first portion of the airflow pathway and the second portion of the airflow pathway may be of substantially constant annular cross-section.

Alternatively, one or both of the first portion of the airflow pathway and the second portion of the airflow pathway may be of non-constant cross-section. For example, the first portion of the airflow pathway may be tapered such that the transverse cross-section of the first portion of the airflow pathway increases or decreases as the first portion of the airflow pathway extends upstream. Alternatively or in addition, the second portion of the airflow pathway may be tapered such that the transverse cross-section of the second portion of the airflow pathway increases or decreases as the second portion of the airflow pathway extends downstream.

In one preferred embodiment, the transverse cross-section of the first portion of the airflow pathway increases as the first portion of the airflow pathway extends upstream and the transverse cross-section of the second portion of the airflow pathway increases as the second portion of the airflow pathway extends downstream.

Preferably, smoking articles according to the invention comprise an outer wrapper that circumscribes at least a rear portion of the heat source, the aerosol-forming substrate and any other components of the smoking article downstream of the aerosol-forming substrate. Preferably, the outer wrapper is substantially air impermeable. Smoking articles according to the invention may comprise outer wrappers formed from any suitable material or combination of materials. Suitable materials are well known in the art and include, but are not limited to, cigarette paper. The outer wrapper should grip the heat source and aerosol-forming substrate of the smoking article when the smoking article is assembled.

The at least one air inlet downstream of the aerosol-forming substrate for drawing air into the first portion of the airflow pathway is provided in the outer wrapper and any other materials circumscribing components of smoking articles according to the invention through which air may be drawn into the first portion of the airflow pathway. As used herein, the term 'air inlet' is used to describe one or more holes, slits, slots or other apertures in the outer wrapper and any other materials circumscribing components of smoking articles according to the invention downstream of the aerosol-forming substrate through which air may be drawn into the first portion of the airflow pathway.

The number, shape, size and location of the air inlets may be appropriately adjusted to achieve a good smoking performance.

Preferably smoking articles according to the invention comprise an airflow directing element downstream of the aerosol-forming substrate. The airflow directing element defines the first portion of the airflow pathway and the second portion of the airflow pathway. The at least one air inlet is provided between a downstream end of the aerosol-forming substrate and a downstream end of the airflow directing element.

The airflow directing element may abut the aerosol-forming substrate. Alternatively, the airflow directing element may extend into the aerosol-forming substrate. For example, in certain embodiments the airflow directing element may extend a distance of up to 0.5 L into the aerosol-forming substrate, where L is the length of the aerosol-forming substrate.

The airflow directing element may have a length of between about 7 mm and about 50 mm, for example a length of between about 10 mm and about 45 mm or of between about 15 mm and about 30 mm. The airflow directing element may have other lengths depending upon the desired overall length of the smoking article, and the presence and length of other components within the smoking article.

The airflow directing element may comprise an open-ended, substantially air impermeable hollow body. In such embodiments, the exterior of the open-ended, substantially air impermeable hollow body defines one of the first portion of the airflow pathway and the second portion of the airflow pathway and the interior of the open-ended, substantially air impermeable hollow body defines the other of the first portion of the airflow pathway and the second portion of the airflow pathway.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

Preferably, the exterior of the open-ended, substantially air impermeable hollow body defines the first portion of the airflow pathway and the interior of the open-ended, substantially air impermeable hollow body defines the second portion of the airflow pathway.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 mm and about 50 mm, for example a length of between about 10 mm and about 45 mm or between about 15 mm and about 30 mm. The open-ended, substantially air impermeable hollow body may have other lengths depending upon the desired overall length of the smoking article, and the presence and length of other components within the smoking article.

Where the open-ended, substantially air impermeable hollow body is a cylinder, the cylinder may have a diameter of between about 2 mm and about 5 mm, for example a diameter of between about 2.5 mm and about 4.5 mm. The cylinder may have other diameters depending upon the desired overall diameter of the smoking article.

Where the open-ended, substantially air impermeable hollow body is a truncated cone, the upstream end of the truncated cone may have a diameter of between about 2 mm and about 5 mm, for example a diameter of between about 2.5 mm and about 4.5 mm. The upstream end of the truncated cone may have other diameters depending upon the desired overall diameter of the smoking article Where the open-ended, substantially air impermeable hollow body is a truncated cone, the downstream end of the truncated cone may have a diameter of between about 5 mm and about 9 mm, for example of between about 7 mm and about 8 mm. The downstream end of the truncated cone may have other diameters depending upon the desired overall diameter of the smoking article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5 L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

Where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the at least one air inlet. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the heat source to the aerosol-forming substrate. Suitable air permeable materials are known in the art and include, but are not limited to, porous materials such as, for example, cellulose acetate tow, cotton, open-cell ceramic and polymer foams, tobacco material and combinations thereof. In certain preferred embodiments, the air permeable diffuser comprises a substantially homogeneous, air permeable porous material.

In one preferred embodiment, the airflow directing element comprises an open ended, substantially air impermeable, hollow tube of reduced diameter compared to the aerosol-forming substrate and an annular substantially air impermeable seal of substantially the same outer diameter as the aerosol-forming substrate, which circumscribes the hollow tube downstream of the at least one air inlet.

In this embodiment, the volume bounded radially by the exterior of the hollow tube and an outer wrapper of the smoking article defines the first portion of the airflow pathway that extends longitudinally upstream from the at least one air inlet towards the aerosol-forming substrate and the volume bounded radially by the interior of the hollow tube defines the second portion of the airflow pathway that extends longitudinally downstream towards the mouth end of the smoking article.

The airflow directing element may further comprise an inner wrapper, which circumscribes the hollow tube and the annular substantially air impermeable seal.

In this embodiment, the volume bounded radially by the exterior of the hollow tube and the inner wrapper of the airflow directing element defines the first portion of the airflow pathway that extends longitudinally upstream from the at least one air inlet towards the aerosol-forming substrate and the volume bounded by the interior of the hollow tube defines the second portion of the airflow pathway that extends longitudinally downstream towards the mouth end of the smoking article.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

Where the airflow directing element further comprises an inner wrapper, the inner wrapper may circumscribe the hollow tube, the annular substantially air impermeable seal and the annular air permeable diffuser.

In use, when a user draws on the mouth end of the smoking article, cool air is drawn into the smoking article through the at least one air inlet downstream of the aerosol-forming substrate. The drawn air passes upstream to the aerosol-forming substrate along the first portion of the airflow pathway between the exterior of the hollow tube and the outer wrapper of the smoking article or inner wrapper of the airflow directing element. The drawn air passes through the aerosol-forming substrate and then passes downstream along the second portion of the airflow pathway through the interior of the hollow tube towards the mouth end of the smoking article for inhalation by the user.

Where the airflow directing element comprises an annular air permeable diffuser, the drawn air passes through the annular air permeable diffuser as it passes upstream along the first portion of the airflow pathway towards the aerosol-forming substrate.

In another preferred embodiment, the airflow directing element comprises an open ended, substantially air impermeable, truncated hollow cone having an upstream end of reduced diameter compared to the aerosol-forming substrate and a downstream end of substantially the same diameter as the aerosol-forming substrate.

In this embodiment, the volume bounded radially by the exterior of the truncated hollow cone and an outer wrapper of the smoking article defines the first portion of the airflow pathway that extends longitudinally upstream from the at least one air inlet towards the aerosol-forming substrate and the volume bounded radially by the interior of the truncated hollow cone defines the second portion of the airflow pathway that extends longitudinally downstream towards the mouth end of the smoking article.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

In use, when a user draws on the mouth end of the smoking article, cool air is drawn into the smoking article through the at least one air inlet downstream of the aerosol-forming substrate. The drawn air passes upstream to the aerosol-forming substrate along the first portion of the airflow pathway between the outer wrapper of the smoking article and the exterior of the truncated hollow cone of the airflow directing element. The drawn air passes through the aerosol-forming substrate and then passes downstream along the second portion of the airflow pathway through the interior of the truncated hollow cone towards the mouth end of the smoking article for inhalation by the user.

Where the airflow directing element comprises an annular air permeable diffuser, the drawn air passes through the annular air permeable diffuser as it passes upstream along the first portion of the airflow pathway towards the aerosol-forming substrate.

Smoking articles according to the invention may comprise at least one additional air inlet.

For example, smoking articles according to the invention may comprise at least one additional air inlet between a downstream end of the heat source and an upstream end of the aerosol-forming substrate. In such embodiments, when a user puffs on the mouth end of the smoking article cool air is also drawn into the smoking article through the at least one additional air inlet between the downstream end of the heat source and the upstream end of the aerosol-forming substrate. The air drawn through the at least one additional air inlet passes downstream through the aerosol-forming substrate and then downstream towards the mouth end of the smoking article through the second portion of the airflow pathway.

Alternatively or in addition, smoking articles according to the invention may comprise at least one additional air inlet about the periphery of the aerosol-forming substrate. In such embodiments, when a user puffs on the mouth end of the smoking article cool air is also drawn into the aerosol-forming substrate through the at least one additional air inlet about the periphery of the aerosol-forming substrate. The air drawn through the at least one additional air inlet passes downstream through the aerosol-forming substrate and then downstream towards the mouth end of the smoking article through the second portion of the airflow pathway.

The heat source may be a combustible heat source, a chemical heat source, an electrical heat source a heat sink or any combination thereof.

Preferably, the heat source is a combustible heat source. More preferably, the combustible heat source is a carbonaceous heat source. As used herein, the term 'carbonaceous' is used to describe a combustible heat source comprising carbon.

Preferably, combustible carbonaceous heat sources for use in smoking articles according to the invention have a carbon content of at least about 35 percent, more preferably of at least about 40 percent, most preferably of at least about 45 percent by dry weight of the combustible heat source.

In some embodiments, combustible heat sources according to the invention are combustible carbon-based heat sources. As used herein, the term 'carbon-based heat source' is used to describe a heat source comprised primarily of carbon.

Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

In one preferred embodiment, the combustible heat source is a cylindrical combustible heat source comprising carbon and at least one ignition aid, the cylindrical combustible heat source having a front end face (that is, upstream end face) and an opposed rear face (that is, downstream end face), wherein at least part of the cylindrical combustible heat source between the front face and the rear face is wrapped in a combustion resistant wrapper and wherein upon ignition of the front face of the cylindrical combustible heat source the rear face of the cylindrical combustible heat source increases in temperature to a first temperature and wherein during subsequent combustion of the cylindrical combustible heat source the rear face of the cylindrical combustible heat source maintains a second temperature lower than the first temperature. Preferably, the at least one ignition aid is present in an amount of at least about 20 percent by dry weight of the combustible heat source. Preferably, the combustion resistant wrapper is one or both of heat conducting and substantially oxygen impermeable.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

While advantageously improving the ignition and combustion properties of the combustible heat source, the inclusion of ignition and combustion additives can give rise to undesirable decomposition and reaction products during use of the smoking article. For example, decomposition of nitrates included in the combustible heat source to aid ignition thereof can result in the formation of nitrogen oxides. In addition, the inclusion of oxidisers, such as nitrates or other additives to aid ignition can result in generation of hot gases and high temperatures in the combustible heat source during ignition of the combustible heat source.

In smoking articles according to the invention the heat source is preferably isolated from all airflow pathways along which air may be drawn through the smoking article for inhalation by a user such that, in use, air drawn through the smoking article does not directly contact the heat source.

In embodiments where the heat source is a combustible heat source, isolation of the combustible heat source from air drawn through the smoking article advantageously substantially prevents or inhibits combustion and decomposition products and other materials formed during ignition and combustion of the combustible heat source of smoking articles according to the invention from entering air drawn through the smoking articles.

Isolation of the combustible heat source from air drawn through the smoking article also advantageously substantially prevents or inhibits activation of combustion of the combustible heat source of smoking articles according to the invention during puffing by a user. This substantially prevents or inhibits spikes in the temperature of the aerosol-forming substrate during puffing by a user.

By preventing or inhibiting activation of combustion of the combustible heat source, and so preventing or inhibiting excess temperature increases in the aerosol-forming substrate, combustion or pyrolysis of the aerosol-forming substrate of smoking articles according to the invention under intense puffing regimes may be advantageously avoided. In addition, the impact of a user's puffing regime on the composition of the mainstream aerosol of smoking articles according to the invention may be advantageously minimised or reduced.

Isolation of the heat source from the air drawn through the smoking article isolates the heat source from the aerosol-forming substrate. Isolation of the heat source from the aerosol-forming substrate may advantageously substantially prevent or inhibit migration of components of the aerosol-forming substrate of smoking articles according to the invention to the heat source during storage of the smoking articles.

Alternatively or in addition, isolation of the heat source from the air drawn through the smoking article may advantageously substantially prevent or inhibit migration of components of the aerosol-forming substrate of smoking articles according to the invention to the heat source during use of the smoking articles.

As described further below, isolation of the heat source from air drawn through the smoking article and the aerosol-forming substrate is particularly advantageous where the aerosol-forming substrate comprises at least one aerosol-former.

In embodiments where the heat source is a combustible heat source, to isolate the combustible heat source from air drawn through the smoking article, smoking articles according to the invention may comprise a non-combustible, substantially air impermeable, barrier between a downstream end of the combustible heat source and an upstream end of the aerosol-forming substrate.

As used herein, the term 'non-combustible' is used to describe a barrier that is substantially non-combustible at temperatures reached by the combustible heat source during combustion or ignition thereof.

The barrier may abut one or both of the downstream end of the combustible heat source and the upstream end of the aerosol-forming substrate.

The barrier may be adhered or otherwise affixed to one or both of the downstream end of the combustible heat source and the upstream end of the aerosol-forming substrate.

In some embodiments, the barrier comprises a barrier coating provided on a rear face of the combustible heat source. In such embodiments, preferably the barrier comprises a barrier coating provided on at least substantially the entire rear face of the combustible heat source. More preferably, the barrier comprises a barrier coating provided on the entire rear face of the combustible heat source.

As used herein, the term 'coating' is used to describe a layer of material that covers and is adhered to the combustible heat source.

The barrier may advantageously limit the temperature to which the aerosol-forming substrate is exposed during ignition or combustion of the combustible heat source, and so help to avoid or reduce thermal degradation or combustion of the aerosol-forming substrate during use of the smoking article. This is particularly advantageous where the combustible heat source comprises one or more additives to aid ignition of the combustible heat source.

Depending upon the desired characteristics and performance of the smoking article, the barrier may have a low thermal conductivity or a high thermal conductivity. In certain embodiments, the barrier may be formed from material having a bulk thermal conductivity of between about 0.1 W per meter Kelvin (W/(m·K)) and about 200 W per meter Kelvin (W/(m·K)) at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In one embodiment, the barrier comprises a clay coating comprising a 50/50 mixture of bentonite and kaolinite provided on the rear face of the combustible heat source. In one more preferred embodiment, the barrier comprises an aluminium coating provided on a rear face of the combustible heat source. In another preferred embodiment, the barrier comprises a glass coating, more preferably a sintered glass coating, provided on a rear face of the combustible heat source.

Preferably, the barrier has a thickness of at least about 10 microns. Due to the slight permeability of clays to air, in embodiments where the barrier comprises a clay coating provided on the rear face of the combustible heat source the clay coating more preferably has a thickness of at least about 50 microns, and most preferably of between about 50 microns and about 350 microns. In embodiments where the barrier is formed from one or more materials that are more impervious to air, such as aluminium, the barrier may be thinner, and generally will preferably have a thickness of less than about 100 microns, and more preferably of about 20 microns. In embodiments where the barrier comprises a glass coating provided on the rear face of the combustible heat source, the glass coating preferably has a thickness of less than about 200 microns. The thickness of the barrier may be measured using a microscope, a scanning electron microscope (SEM) or any other suitable measurement methods known in the art.

Where the barrier comprises a barrier coating provided on a rear face of the combustible heat source, the barrier coating may be applied to cover and adhere to the rear face of the combustible heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear face of the combustible heat source, and applying it to the rear face of the combustible heat source to cover and adhere to at least substantially the entire rear face of the combustible heat source. Alternatively, the barrier coating may be cut or otherwise machined after it is applied to the rear face of the combustible heat source. In one preferred embodiment, aluminium foil is applied to the rear face of the combustible heat source by gluing or pressing it to the combustible heat source, and is cut or otherwise machined so that the aluminium foil covers and adheres to at least substantially the entire rear face of the combustible heat source, preferably to the entire rear face of the combustible heat source.

In another preferred embodiment, the barrier coating is formed by applying a solution or suspension of one or more suitable coating materials to the rear face of the combustible heat source. For example, the barrier coating may be applied to the rear face of the combustible heat source by dipping the rear face of the combustible heat source in a solution or suspension of one or more suitable coating materials or by brushing or spray-coating a solution or suspension or electrostatically depositing a powder or powder mixture of one or more suitable coating materials onto the rear face of the combustible heat source. Where the barrier coating is applied to the rear face of the combustible heat source by electrostatically depositing a powder or powder mixture of one or more suitable coating materials onto the rear face of the combustible heat source, the rear face of the combustible heat source is preferably pre-treated with water glass before electrostatic deposition. Preferably, the barrier coating is applied by spray-coating.

The barrier coating may be formed through a single application of a solution or suspension of one or more suitable coating materials to the rear face of the combustible heat source. Alternatively, the barrier coating may be formed through multiple applications of a solution or suspension of one or more suitable coating materials to the rear face of the combustible heat source. For example, the barrier coating may be formed through one, two, three, four, five, six, seven or eight successive applications of a solution or suspension of one or more suitable coating materials to the rear face of the combustible heat source.

Preferably, the barrier coating is formed through between one and ten applications of a solution or suspension of one or more suitable coating materials to the rear face of the combustible heat source.

After application of the solution or suspension of one or more coating materials to the rear face thereof, the combustible heat source may be dried to form the barrier coating.

Where the barrier coating is formed through multiple applications of a solution or suspension of one or more suitable coating materials to the rear face thereof, the combustible heat source may need to be dried between successive applications of the solution or suspension.

Alternatively or in addition to drying, after application of a solution or suspension of one or more coating materials to the rear face of the combustible heat source, the coating material on the combustible heat source may be sintered in order to form the barrier coating. Sintering of the barrier coating is particularly preferred where the barrier coating is a glass or ceramic coating. Preferably, the barrier coating is sintered at a temperature of between about 500° C. and about 900° C., and more preferably at about 700° C.

In certain embodiments, smoking articles according to the invention may comprise heat sources that do not comprise any airflow channels. The heat sources of smoking articles according to such embodiments are referred to herein as blind heat sources.

In smoking articles according to the invention comprising blind heat sources, heat transfer from the heat source to the aerosol-forming substrate occurs primarily by conduction and heating of the aerosol-forming substrate by convection is minimised or reduced. This advantageously helps to minimise or reduce the impact of a user's puffing regime on the composition of the mainstream aerosol of smoking articles according to the invention comprising blind heat sources.

It will be appreciated that smoking articles according to the invention may comprise blind heat sources comprising one or more closed or blocked passageways through which air may not be drawn for inhalation by a user. For example, smoking articles according to the invention may comprise blind combustible heat sources comprising one or more closed passageways that extend from an upstream end face of the combustible heat source only part way along the length of the combustible heat source.

In such embodiments, the inclusion of one or more closed air passageways increases the surface area of the combustible heat source that is exposed to oxygen from the air and may advantageously facilitate ignition and sustained combustion of the combustible heat source.

In other embodiments, smoking articles according to the invention may comprise heat sources comprising one or more airflow channels. The heat sources of smoking articles according to such embodiments are referred to herein as non-blind heat sources.

In smoking articles according to the invention comprising non-blind heat sources, heating of the aerosol-forming substrate occurs by conduction and convection. In use, when a user puffs on a smoking article according to the invention comprising a non-blind heat source air is drawn downstream through the one or more airflow channels along the heat source. The drawn air passes through the aerosol-forming substrate and then downstream towards the mouth end of the smoking article through the second portion of the airflow pathway.

Smoking articles according to the invention may comprise non-blind heat sources comprising one or more enclosed airflow channels along the heat source.

As used herein, the term 'enclosed' is used to describe airflow channels that are surrounded by the heat source along their length.

For example, smoking articles according to the invention may comprise non-blind combustible heat sources comprising one or more enclosed airflow channels that extend through the interior of the combustible heat source along the entire length of the combustible heat source.

Alternatively or in addition, smoking articles according to the invention may comprise non-blind heat sources comprising one or more non-enclosed airflow channels along the combustible heat source.

For example, smoking articles according to the invention may comprise non-blind combustible heat sources comprising one or more non-enclosed airflow channels that extend along the exterior of the combustible heat source along at least a downstream portion of the length of the combustible heat source.

In certain embodiments, smoking articles according to the invention may comprise non-blind heat sources comprising one, two or three airflow channels. In certain preferred embodiments, smoking articles according to the invention comprise non-blind combustible heat sources comprising a single airflow channel extending through the interior of the combustible heat source. In certain particularly preferred embodiments, smoking articles according to the invention comprise non-blind combustible heat sources comprising a single substantially central or axial airflow channel extending through the interior of the combustible heat source. In such embodiments, the diameter of the single airflow channel is preferably between about 1.5 mm and about 3 mm.

Where smoking articles according to the invention comprise a barrier comprising a barrier coating provided on a rear face of a non-blind combustible heat source comprising one or more airflow channels along the combustible heat source, the barrier coating should allow air to be drawn downstream through the one or more airflow channels.

Where smoking articles according to the invention comprise non-blind combustible heat sources, the smoking articles may further comprise a non-combustible, substantially air impermeable, barrier between the combustible heat source and the one or more airflow channels to isolate the non-blind combustible heat source from air drawn through the smoking article.

In some embodiments, the barrier may be adhered or otherwise affixed to the combustible heat source.

Preferably, the barrier comprises a barrier coating provided on an inner surface of the one or more airflow channels. More preferably, the barrier comprises a barrier coating provided on at least substantially the entire inner surface of the one or more airflow channels. Most preferably, the barrier comprises a barrier coating provided on the entire inner surface of the one or more airflow channels.

Alternatively, the barrier coating may be provided by insertion of a liner into the one or more airflow channels. For example, where smoking articles according to the invention comprise non-blind combustible heat sources comprising one or more airflow channels that extend through the interior of the combustible heat source, a non-combustible, substantially air impermeable hollow tube may be inserted into each of the one or more airflow channels.

The barrier may advantageously substantially prevent or inhibit combustion and decomposition products formed during ignition and combustion of the combustible heat source of smoking articles according to the invention from entering air drawn downstream along the one or more airflow channels.

The barrier may also advantageously substantially prevent or inhibit activation of combustion of the combustible heat source of smoking articles according to the invention during puffing by a user.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where smoking articles according to the invention comprise a barrier between a downstream end of the combustible heat source and an upstream end of the aerosol-forming substrate and a barrier between the combustible heat source and one or more airflow channels along the combustible heat source, the two barriers may be formed from the same or different material or materials.

Where the barrier between the combustible heat source and the one or more airflow channels comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In a preferred embodiment, the barrier coating is applied to the inner surface of the one or more airflow channels by the process described in WO-A2-2009/074870 as the combustible heat source is extruded.

Combustible carbonaceous heat sources for use in smoking articles according to the invention, are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction. In certain preferred embodiments, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed preferably in a nitrogen atmosphere at a temperature of between about 700° C. and about 900° C.

In one embodiment, at least one metal nitrate salt is incorporated in the combustible heat source by including at least one metal nitrate precursor in the mixture of one or more carbon containing materials, one or more binders and other additives. The at least one metal nitrate precursor is then subsequently converted in-situ into at least one metal nitrate salt by treating the pyrolysed pre-formed cylindrical rod or other shape with an aqueous solution of nitric acid. In one embodiment, the combustible heat source comprises at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In use, exposure of the combustible heat source to a conventional yellow flame lighter or other ignition means should cause the at least one metal nitrate salt to decompose and release oxygen and energy. This decomposition causes an initial boost in the temperature of the combustible heat source and also aids in the ignition of the combustible heat source. Following decomposition of the at least one metal nitrate salt, the combustible heat source preferably continues to combust at a lower temperature.

The inclusion of at least one metal nitrate salt advantageously results in ignition of the combustible heat source being initiated internally, and not only at a point on the surface thereof. Preferably, the at least one metal nitrate salt is present in the combustible heat source in an amount of between about 20 percent by dry weight and about 50 percent by dry weight of the combustible heat source.

In another embodiment, the combustible heat source comprises at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably at a temperature of between about 200° C. and about 400° C., most preferably at a temperature of about 350° C.

In use, exposure of the combustible heat source to a conventional yellow flame lighter or other ignition means should cause the at least one peroxide or superoxide to decompose and release oxygen. This causes an initial boost in the temperature of the combustible heat source and also aids in the ignition of the combustible heat source. Following decomposition of the at least one peroxide or superoxide, the combustible heat source preferably continues to combust at a lower temperature.

The inclusion of at least one peroxide or superoxide advantageously results in ignition of the combustible heat source being initiated internally, and not only at a point on the surface thereof.

The combustible heat source preferably has a porosity of between about 20 percent and about 80 percent, more preferably of between about 20 percent and 60 percent. Where the combustible heat source comprises at least one metal nitrate salt, this advantageously allows oxygen to diffuse into the mass of the combustible heat source at a rate sufficient to sustain combustion as the at least one metal nitrate salt decomposes and combustion proceeds. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 $g/cm^3$ and about 1 $g/cm^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the heat source is of substantially uniform diameter. However, the heat source may alternatively be tapered so that the diameter of the rear portion of the heat source is greater than the diameter of the front portion thereof. Particularly preferred are heat sources that are substantially cylindrical. The heat source may, for example, be a cylinder or tapered cylinder of substantially circular cross-section or a cylinder or tapered cylinder of substantially elliptical cross-section.

Smoking articles according to the invention preferably comprise an aerosol-forming substrate comprising at least one aerosol-former. The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

In such embodiments, isolation of the heat source from the aerosol-forming substrate advantageously prevents or inhibits migration of the at least one aerosol-former from the aerosol-forming substrate to the heat source during storage of the smoking articles. In such embodiments, isolation of the heat source from air drawn through the smoking article may also advantageously substantially prevent or inhibit migration of the at least one aerosol former from the aerosol-forming substrate to the heat source during use of the smoking articles. Decomposition of the at least one aerosol-former during use of the smoking articles is thus advantageously substantially avoided or reduced.

The heat source and aerosol-forming substrate of smoking articles according to the invention may substantially abut one another. Alternatively, the heat source and aerosol-forming substrate of smoking articles according to the invention may be longitudinally spaced apart from one another one another.

Preferably, smoking articles according to the invention further comprise a heat-conducting element around and in direct contact with a rear portion of the heat source and an adjacent front portion of the aerosol-forming substrate. The heat-conducting element is preferably combustion resistant and oxygen restricting.

The heat-conducting element is around and in direct contact with the peripheries of both the rear portion of the combustible heat source and the front portion of the aerosol-generating substrate. The heat-conducting element provides a thermal link between these two components of smoking articles according to the invention.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

In embodiments where the heat source is a combustible heat source, the rear portion of the combustible heat source surrounded by the heat-conducting element is preferably between about 2 mm and about 8 mm in length, more preferably between about 3 mm and about 5 mm in length.

Preferably, the front portion of the combustible heat source not surrounded by the heat-conducting element is between about 4 mm and about 15 mm in length, more preferably between about 4 mm and about 8 mm in length.

Preferably, the aerosol-forming substrate has a length of between about 5 mm and about 20 mm, more preferably of between about 8 mm and about 12 mm.

In certain preferred embodiments, the aerosol-forming substrate extends at least about 3 mm downstream beyond the heat-conducting element.

Preferably, the front portion of the aerosol-forming substrate surrounded by the heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the heat-conducting element is between about 3 mm and about 10 mm in length. In other words, the aerosol-forming substrate preferably extends between about 3 mm and about 10 mm downstream beyond the heat-conducting element. More preferably, the aerosol-forming substrate extends at least about 4 mm downstream beyond the heat-conducting element.

In other embodiments, the aerosol-forming substrate may extend less than 3 mm downstream beyond the heat-conducting element.

In yet further embodiments, the entire length of the aerosol-forming substrate may be surrounded by the heat-conducting element.

Preferably, smoking articles according to the invention comprise aerosol-forming substrates comprising at least one aerosol-former and a material capable of emitting volatile compounds in response to heating. Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; *eucalyptus*; basil; sage; *verbena*; and tarragon. The plant based-material may comprise additives including, but not limited to, humectants, flavourants, binders and mixtures thereof. Preferably, the plant-based material consists essentially of tobacco material, most preferably homogenised tobacco material.

Smoking articles according to the invention preferably further comprise an expansion chamber downstream of the aerosol-forming substrate and, where present, downstream of the airflow directing element. The inclusion of an expansion chamber advantageously allows further cooling of the aerosol generated by heat transfer from the combustible heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-forming substrate and, where present, downstream of the airflow directing element and expansion chamber. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may, for example, comprise a filter made of cellulose acetate, paper or other suitable known filtration materials. Alternatively or in addition, the mouthpiece may comprise one or more segments comprising absorbents, adsorbents, flavourants, and other aerosol modifiers and additives or combinations thereof.

Features described in relation to one aspect of the invention may also be applicable to other aspects of the invention. In particular, features described in relation to smoking articles and combustible heat sources according to the invention may also be applicable to methods according to the invention.

The invention will be further described, by way of example only, with reference to the accompanying drawings in which.

Figure 1:
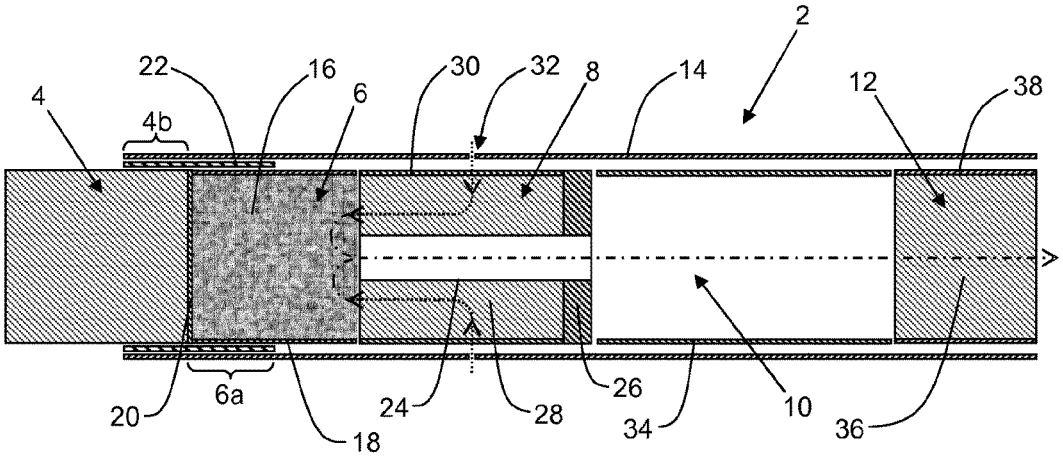
FIG. 1 shows a schematic longitudinal cross-section of a smoking article according to a first embodiment of the invention.

The smoking article 2 according to the first embodiment of the invention shown in FIG. 1 comprises a blind combustible carbonaceous heat source 4, an aerosol-forming substrate 6, an airflow directing element 8, an expansion chamber 10 and a mouthpiece 12 in abutting coaxial alignment. The combustible carbonaceous heat source 4, aerosol-forming substrate 6, airflow directing element 8, elongate expansion chamber 10 and mouthpiece 12 are overwrapped in an outer wrapper 14 of cigarette paper of low air permeability.

The aerosol-forming substrate 6 is located immediately downstream of the combustible carbonaceous heat source 4 and comprises a cylindrical plug 16 of tobacco material comprising glycerine as aerosol former and circumscribed by filter plug wrap 18.

A non-combustible, substantially air impermeable barrier is provided between the downstream end of the combustible heat source 4 and the upstream end of the aerosol-forming substrate 6. As shown in FIG. 1, the non-combustible, substantially air impermeable barrier consists of a non-combustible, substantially air impermeable, barrier coating 20, which is provided on the entire rear face of the combustible carbonaceous heat source 4.

A heat-conducting element 22 consisting of a tubular layer of aluminium foil surrounds and is in direct contact with a rear portion 4*b* of the combustible carbonaceous heat source 4 and an abutting front portion 6*a* of the aerosol-forming substrate 6. As shown in FIG. 1, a rear portion of the aerosol-forming substrate 6 is not surrounded by the heat-conducting element 22.

The airflow directing element 8 is located downstream of the aerosol-forming substrate 6 and comprises an open-ended, substantially air impermeable hollow tube 24 made of, for example, cardboard, which is of reduced diameter compared to the aerosol-forming substrate 6. The upstream end of the open-ended hollow tube 24 abuts the aerosol-forming substrate 6. The downstream end of the open-ended hollow tube 24 is surrounded by an annular substantially air impermeable seal 26 of substantially the same diameter as the aerosol-forming substrate 6. The remainder of the open-ended hollow tube 24 is circumscribed by an annular air permeable diffuser 28 made of, for example, cellulose acetate tow, which is of substantially the same diameter as the aerosol-forming substrate 6.

The open-ended hollow tube 24, annular substantially air impermeable seal 26 and annular air permeable diffuser 28 may be separate components that are adhered or otherwise connected together to form the airflow directing element 8 prior to assembly of the smoking article 2. Alternatively, the open-ended hollow tube 24 and annular substantially air impermeable seal 26 may be parts of a single component that is adhered or otherwise connected to a separate annular air permeable diffuser 28 to form the airflow directing element 8 prior to assembly of the smoking article. In yet further embodiments, the open-ended hollow tube 24, annular substantially air impermeable seal 26 and annular air permeable diffuser 28 may be parts of a single component. For example, the open-ended hollow tube 24, annular substantially air impermeable seal 26 and annular air permeable diffuser 28 may be parts of a single hollow tube of air permeable material having a substantially air impermeable coating applied to its inner surface and rear face.

As shown in FIG. 1, the open-ended hollow tube 24 and annular air permeable diffuser 28 are circumscribed by an air permeable inner wrapper 30.

As also shown in FIG. 1, a circumferential arrangement of air inlets 32 is provided in the outer wrapper 14 circumscribing the inner wrapper 30.

The expansion chamber 10 is located downstream of the airflow directing element 8 and comprises an open-ended hollow tube 34 made of, for example, cardboard, which is of substantially the same diameter as the aerosol-forming substrate 6.

The mouthpiece 12 of the smoking article 2 is located downstream of the expansion chamber 10 and comprises a cylindrical plug 36 of cellulose acetate tow of very low filtration efficiency circumscribed by filter plug wrap 38. The mouthpiece 12 may be circumscribed by tipping paper (not shown).

As described further below, an airflow pathway extends between the air inlets 32 and the mouthpiece 12 of the smoking article 2 according to the first embodiment of the invention. The volume bounded by the exterior of the open-ended hollow tube 24 of the airflow directing element 8 and the inner wrapper 30 forms a first portion of the airflow pathway that extends longitudinally upstream from the air inlets 32 to the aerosol-forming substrate 6. The volume bounded by the interior of the hollow tube 24 of the airflow directing element 8 forms a second portion of the airflow pathway that extends longitudinally downstream towards the mouth piece 12 of the smoking article 2, between the aerosol-forming substrate 6 and the expansion chamber 10.

In use, when a user draws on the mouthpiece 12 of the smoking article 2 according to the first embodiment of the invention, cool air (shown by dotted arrows in FIG. 1) is drawn into the smoking article 2 through the air inlets 32 and the inner wrapper 30. The drawn air passes upstream to the aerosol-forming substrate 6 along the first portion of the airflow pathway between the exterior of the open-ended hollow tube 24 of the airflow directing element 8 and the inner wrapper 30 and through the annular air permeable diffuser 28.

The front portion 6*a* of the aerosol-forming substrate 6 is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 1) pass downstream along the second portion of the airflow pathway through the interior of the open-ended hollow tube 24 of the airflow directing element 8 to the expansion chamber 10, where they cool and condense. The cooled aerosol then passes downstream through the mouthpiece 12 of the smoking article 2 according to the first embodiment of the invention into the mouth of the user.

The non-combustible, substantially air impermeable, barrier coating 20 provided on the rear face of the combustible carbonaceous heat source 4 isolates the combustible carbonaceous heat source 4 from the airflow pathway through the smoking article 2 such that, in use, air drawn through the smoking article 2 along the first portion and the second portion of the airflow pathway does not directly contact the combustible carbonaceous heat source 4.

Figure 2:
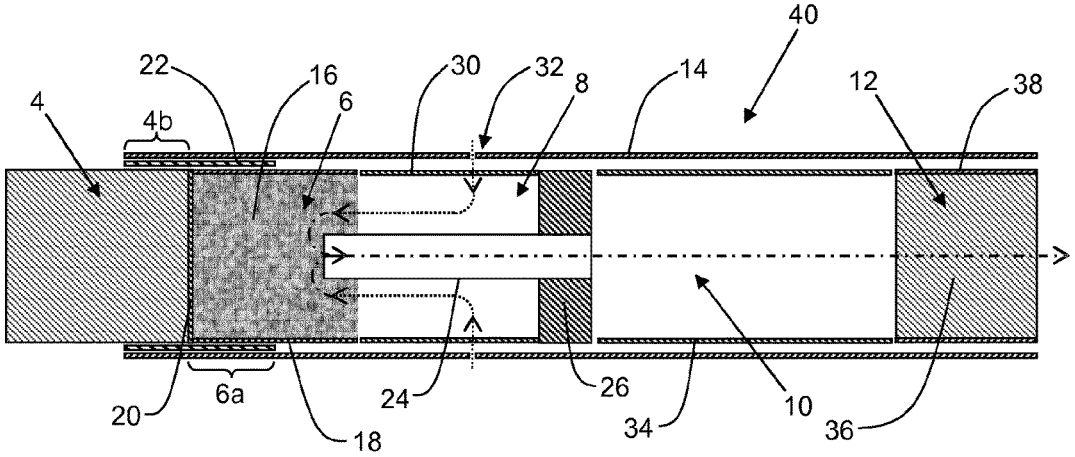
FIG. 2 shows a schematic longitudinal cross-section of a smoking article according to a second embodiment of the invention.

The smoking article 40 according to the second embodiment of the invention shown in FIG. 2 is of similar construction to the smoking article according to the first embodiment of the invention shown in FIG. 1; the same reference numerals are used in FIG. 2 for parts of the smoking article 40 according to the second embodiment of the invention corresponding to parts of the smoking article 2 according to the first embodiment of the invention shown in FIG. 1 and described above.

As shown in FIG. 2, the smoking article 40 according to the second embodiment of the invention differs from the smoking article 2 according to the first embodiment of the invention shown in FIG. 1 in that the open-ended, substantially air impermeable hollow tube 24 of the airflow directing element 8 is not circumscribed by an annular air permeable diffuser 28. The smoking article 40 according to the second embodiment of the invention also differs from the smoking article 2 according to the first embodiment of the invention shown in FIG. 1 in that the upstream end of the open-ended hollow tube 24 extends into the aerosol-forming substrate 6.

In use, when a user draws on the mouthpiece 12 of the smoking article 40 according to the second embodiment of the invention, cool air (shown by dotted arrows in FIG. 2) is drawn into the smoking article 40 through the air inlets 32. The drawn air passes upstream to the aerosol-forming substrate 6 along the first portion of the airflow pathway between the exterior of the open-ended hollow tube 24 of the airflow directing element 8 and the inner wrapper 30.

The front portion 6*a* of the aerosol-forming substrate 6 of the smoking article 40 according to the second embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 2) pass downstream along the second portion of the airflow pathway through the interior of the open-ended hollow tube 24 of the airflow directing element 8 to the expansion chamber 10, where they cool and condense. The cooled aerosol then passes downstream through the mouthpiece 12 of the smoking article 40 according to the second embodiment of the invention into the mouth of the user.

The non-combustible, substantially air impermeable, barrier coating 20 provided on the rear face of the combustible carbonaceous heat source 4 isolates the combustible carbonaceous heat source 4 from the airflow pathway through the smoking article 40 such that, in use, air drawn through the smoking article 40 along the first portion and the second portion of the airflow pathway does not directly contact the combustible carbonaceous heat source 4.

Figure 3:
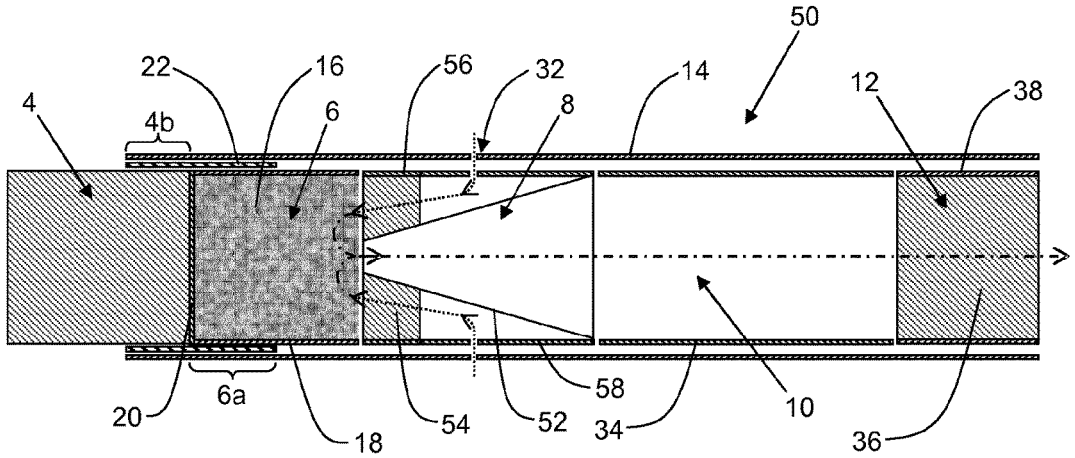
FIG. 3 shows a schematic longitudinal cross-section of a smoking article according to a third embodiment of the invention.

The smoking article 50 according to the third embodiment of the invention shown in FIG. 3 is also of similar construction to the smoking article according to the first embodiment of the invention shown in FIG. 1; the same reference numerals are used in FIG. 3 for parts of the smoking article 50 according to the third embodiment of the invention corresponding to parts of the smoking article 2 according to the first embodiment of the invention shown in FIG. 1 and described above.

As shown in FIG. 3, the construction of the airflow directing element 8 of the smoking article 50 according to the third embodiment of the invention differs from that of the airflow directing element 8 smoking article according to the first embodiment of the invention shown in FIG. 1. In the third embodiment of the invention, the airflow directing element 8 is located downstream of the aerosol-forming substrate 6 and comprises an open-ended, substantially air impermeable truncated hollow cone 52 made of, for example, cardboard. The downstream end of the open-ended truncated hollow cone 52 is of substantially the same diameter as the aerosol-forming substrate 6 and the upstream end of the open-ended truncated hollow cone 52 is of reduced diameter compared to the aerosol-forming substrate 6.

The upstream end of the hollow cone 52 abuts the aerosol-forming substrate 6 and is circumscribed by an air permeable cylindrical plug 54 of substantially the same diameter as the aerosol-forming substrate 6. The air permeable cylindrical plug 58 may be formed from any suitable material including, but not limited to porous materials such as, for example, cellulose acetate tow of very low filtration efficiency.

The upstream end of the open-ended truncated hollow cone 52 abuts the aerosol-forming substrate 6 and is circumscribed by an annular air permeable diffuser 54 made of, for example, cellulose acetate tow, which is of substantially the same diameter as the aerosol-forming substrate 6 and is circumscribed by filter plug wrap 56.

As shown in FIG. 3, the portion of the open-ended truncated hollow cone 52 that is not circumscribed by the annular air permeable diffuser 54 is circumscribed by an inner wrapper 58 of low air permeability made of, for example, cardboard.

As also shown in FIG. 3, a circumferential arrangement of air inlets 32 is provided in the outer wrapper 14 and the inner wrapper 58 circumscribing the open-ended truncated hollow cone 52 downstream of the annular air permeable diffuser 54.

An airflow pathway extends between the air inlets 32 and the mouthpiece 12 of the smoking article 50 according to the third embodiment of the invention. The volume bounded by the exterior of the open-ended truncated hollow cone 52 of the airflow directing element 8 and the inner wrapper 56 forms a first portion of the airflow pathway that extends longitudinally upstream from the air inlets 32 to the aerosol-forming substrate 6. The volume bounded by the interior of the hollow cone 52 of the airflow directing element 8 forms a second portion of the airflow pathway that extends longitudinally downstream towards the mouth piece 12 of the smoking article 50, between the aerosol-forming substrate 6 and the expansion chamber 10.

In use, when a user draws on the mouthpiece 12 of the smoking article 50 according to the third embodiment of the invention, cool air (shown by dotted arrows in FIG. 3) is drawn into the smoking article 50 through the air inlets 32. The drawn air passes upstream to the aerosol-forming substrate 6 along the first portion of the airflow pathway between the exterior of the open-ended truncated hollow cone 52 of the airflow directing element 8 and the inner wrapper 56 and through the annular air permeable diffuser 54.

The front portion 6*a* of the aerosol-forming substrate 6 of the smoking article 50 according to the third embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug 16 of tobacco material, which form an aerosol that is entrained in the drawn air as it flows through the aerosol-forming substrate 6. The drawn air and entrained aerosol (shown by dashed and dotted arrows in FIG. 3) pass downstream along the second portion of the airflow pathway through the interior of the open-ended truncated hollow cone 52 of the airflow directing element 8 to the expansion chamber 10, where they cool and condense. The cooled aerosol then passes downstream through the mouthpiece 12 of the smoking article 50 according to the third embodiment of the invention into the mouth of the user.

The non-combustible, substantially air impermeable, barrier coating 20 provided on the rear face of the combustible carbonaceous heat source 4 isolates the combustible carbonaceous heat source 4 from the airflow pathway through the smoking article 50 such that, in use, air drawn through the smoking article 50 along the first portion and the second portion of the airflow pathway does not directly contact the combustible carbonaceous heat source 4.

Figure 4:
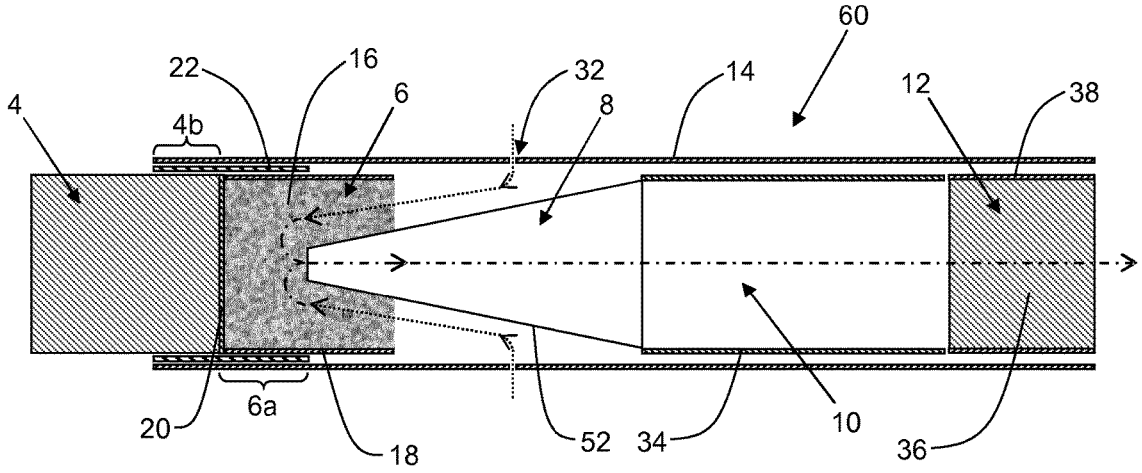
FIG. 4 shows a schematic longitudinal cross-section of a smoking article according to a fourth embodiment of the invention.

As shown in FIG. 4, the smoking article 60 according to the fourth embodiment of the invention differs from the smoking article 50 according to the third embodiment of the invention shown in FIG. 3 in that the upstream end of the open-ended, substantially air impermeable, truncated hollow cone 52 of the airflow directing element 8 extends into the aerosol-forming substrate 6 and is not circumscribed by an annular air permeable diffuser 54. The smoking article 60 according to the fourth embodiment of the invention further differs from the smoking article 50 according to the third embodiment of the invention shown in FIG. 3 in that the substantially air impermeable, truncated hollow cone 52 is not circumscribed by an inner wrapper 58.

In use, when a user draws on the mouthpiece 12 of the smoking article 60 according to the fourth embodiment of the invention, cool air (shown by dotted arrows in FIG. 4) is drawn into the smoking article 60 through the air inlets 32. The drawn air passes upstream to the aerosol-forming substrate 6 along the first portion of the airflow pathway between the exterior of the open-ended truncated hollow cone 52 of the airflow directing element 8 and the outer wrapper 14.

The front portion 6*a* of the aerosol-forming substrate 6 of the smoking article 60 according to the fourth embodiment of the invention is heated by conduction through the abutting rear portion 4*b* of the combustible carbonaceous heat source 4 and the heat-conducting element 22. The heating of the aerosol-forming substrate 6 releases volatile and semi-volatile compounds and glycerine from the plug of tobacco material 16, which form an aerosol that is entrained in the drawn air as it flows through the aerosol-forming substrate 6. The drawn air and entrained aerosol (shown by dashed and dotted arrows in FIG. 4) pass downstream along the second portion of the airflow pathway through the interior of the open-ended truncated hollow cone 52 of the airflow directing element 8 to the expansion chamber 10, where they cool and condense. The cooled aerosol then passes downstream through the mouthpiece 12 of the smoking article 60 according to the fourth embodiment of the invention into the mouth of the user.

The non-combustible, substantially air impermeable, barrier coating 20 provided on the rear face of the combustible carbonaceous heat source 4 isolates the combustible carbonaceous heat source 4 from the airflow pathway such that, in use, air drawn through the smoking article 60 along the first portion and the second portion of the airflow pathway does not directly contact the combustible carbonaceous heat source 4.

Smoking articles according to the first, second and third embodiments of the invention shown in FIGS. 1, 2 and 3, respectively, and having the dimensions shown in Table 1 were assembled.

The embodiments shown in FIGS. 1 to 4 and described above illustrate but do not limit the invention. Other embodiments of the invention may be made without departing from the spirit and scope thereof, and it is to be understood that the specific embodiments described herein are not limiting.

TABLE 1

| | First embodiment | Second embodiment | Third embodiment |
|---|---|---|---|
| **Smoking article** | | | |
| Overall length (mm) | 84 | 84 | 84 |
| Diameter (mm) | 7.8 | 7.8 | 7.8 |
| **Porous carbonaceous heat source** | | | |
| Length (mm) | 8 | 8 | 8 |
| Diameter (mm) | 7.8 | 7.8 | 7.8 |
| Thickness of barrier coating (microns) | ≤500 | ≤500 | ≤500 |
| **Aerosol-forming substrate** | | | |
| Length (mm) | 10 | 10 | 10 |
| Diameter (mm) | 7.8 | 7.8 | 7.8 |
| Density (g/cm$^3$) | 0.73 | 0.73 | 0.73 |
| Aerosol former | Glycerine | Glycerine | Glycerine |
| Amount of aerosol former | 20% by dry wt. of tobacco | 20% by dry wt. of tobacco | 20% by dry wt. of tobacco |
| **Airflow directing element** | | | |
| Length (mm) | 26 | 26 | 18 |
| Diameter (mm) | 7.8 | 7.8 | 7.8 |
| Length of air permeable plug (mm) | 24 | — | 5 |
| Diameter of hollow tube (mm) | 3.5 | 3.5 | — |
| Length of hollow tube (mm) | 26 | 31 | — |
| Length of hollow tube extending in aerosol-forming substrate(mm) | — | 5 | — |
| Number of air inlets | 4-8 | 4-8 | 4-8 |
| Diameter of air inlets (mm) | 0.2 | 0.2 | 0.2 |
| Distance of air inlets from distal end (mm) | 24 | 29 | 27 |
| **Expansion chamber** | | | |
| Length (mm) | 33 | 33 | 41 |
| Diameter (mm) | 7.8 | 7.8 | 7.8 |
| **Mouthpiece** | | | |
| Length (mm) | 7 | 7 | 7 |
| Diameter (mm) | 7.8 | 7.8 | 7.8 |
| **Heat-conducting element** | | | |
| Length (mm) | 8 | 8 | 7 |
| Diameter (mm) | 7.8 | 7.8 | 7.8 |
| Thickness of aluminium foil | 20 | 20 | 20 |

TABLE 1-continued

| | First embodiment | Second embodiment | Third embodiment |
|---|---|---|---|
| (microns) | | | |
| Length of rear portion of combustible carbonaceous heat source (mm) | 4 | 4 | 3 |
| Length of front portion of aerosol-forming substrate (mm) | 4 | 4 | 4 |
| Length of rear portion of aerosol-forming substrate (mm) | 6 | 6 | 6 |

The invention claimed is:

1. A smoking article having a mouth end and a distal end, the smoking article comprising:

a blind heat source;

an aerosol-forming substrate downstream of the heat source;

at least one air inlet downstream of the aerosol-forming substrate;

an airflow pathway extending between the at least one air inlet and the mouth end of the smoking article, wherein the airflow pathway comprises a first portion extending longitudinally upstream from the at least one air inlet towards the aerosol-forming substrate, and a second portion extending longitudinally downstream from the first portion towards the mouth end of the smoking article; and an airflow directing element downstream of the aerosol-forming substrate, the airflow directing element defining the first portion of the airflow pathway and the second portion of the airflow pathway, wherein the airflow directing element comprises an open-ended, substantially air impermeable hollow body, and wherein at least a portion of a length of the open-ended, substantially air impermeable hollow body is circumscribed by an air permeable diffuser.

2. The smoking article according to claim 1, wherein the first portion of the airflow pathway extends upstream from the at least one air inlet to the aerosol-forming substrate, and the second portion of the airflow pathway extends downstream from the aerosol-forming substrate towards the mouth end of the smoking article.

3. The smoking article according to claim 1, wherein the first portion of the airflow pathway extends upstream from the at least one air inlet to the aerosol-forming substrate, and the second portion of the airflow pathway extends downstream from within the aerosol-forming substrate towards the mouth end of the smoking article.

4. The smoking article according to claim 1, wherein the first portion of the airflow pathway and the second portion of the airflow pathway are concentric.

5. The smoking article according to claim 1, wherein the first portion of the airflow pathway surrounds the second portion of the airflow pathway.

6. The smoking article according to claim 1, wherein the first portion of the airflow pathway and the second portion of the airflow pathway are of substantially constant transverse cross-section.

7. The smoking article according to claim 1, wherein a transverse cross-section of the first portion of the airflow pathway increases as the first portion of the airflow pathway extends upstream and a transverse cross-section of the second portion of the airflow pathway increases as the second portion of the airflow pathway extends downstream.

8. The smoking article according to claim 1, wherein the hollow body is a right circular cylinder.

9. The smoking article according to claim 1, wherein the hollow body is a truncated right circular cone.

10. The smoking article according to claim 1, wherein the heat source is a combustible heat source.

11. The smoking article according to claim 10, wherein the combustible heat source is isolated from the airflow pathway such that air drawn along the airflow pathway does not directly contact the combustible heat source.

12. The smoking article according to claim 1, further comprising:

a heat-conducting element around and in contact with a rear portion of the heat source and a front portion of the aerosol-forming substrate.

13. A method of reducing or eliminating increases in temperature of an aerosol-forming substrate of a smoking article during puffing, the method comprising:

providing a smoking article, comprising:

a blind heat source;

an aerosol-forming substrate downstream of the heat source;

at least one air inlet downstream of the aerosol-forming substrate;

an airflow pathway extending between the at least one air inlet and the mouth end of the smoking article, wherein the airflow pathway comprises a first portion extending longitudinally upstream from the at least one air inlet towards the aerosol-forming substrate, and a second portion extending longitudinally downstream from the first portion towards the mouth end of the smoking article; and an airflow directing element downstream of the aerosol-forming substrate, the airflow directing element defining the first portion of the airflow pathway and the second portion of the airflow pathway, wherein the airflow directing element comprises an open-ended, substantially air impermeable hollow body, and wherein at least a portion of a length of the open-ended, substantially air impermeable hollow body is circumscribed by an air permeable diffuser; and drawing air into the smoking article through the at least one air inlet, the air passing upstream through the first portion of the airflow pathway towards the aerosol-forming substrate and then downstream towards the mouth end of the smoking article through the second portion of the airflow pathway.

14. The smoking article according to claim 10, wherein the combustible heat source is a carbonaceous heat source.

15. A smoking article having a mouth end and a distal end, the smoking article comprising:

a blind heat source;

an aerosol-forming substrate downstream of the heat source;

at least one air inlet downstream of the aerosol-forming substrate; and an airflow pathway extending between the at least one air inlet and the mouth end of the smoking article, wherein the airflow pathway comprises a first portion extending longitudinally upstream from the at least one air inlet towards the aerosol-forming substrate and a second portion extending longitudinally downstream from the first portion towards the mouth end of the smoking article, wherein a transverse cross-section of the first portion of the airflow pathway increases as the first portion of the airflow pathway extends upstream.

16. The smoking article according to claim 15, wherein the first portion of the airflow pathway extends upstream from the at least one air inlet to the aerosol-forming substrate, and the second portion of the airflow pathway extends downstream from the aerosol-forming substrate towards the mouth end of the smoking article.

17. The smoking article according to claim 15, wherein the first portion of the airflow pathway extends upstream from the at least one air inlet to the aerosol-forming substrate, and the second portion of the airflow pathway extends downstream from within the aerosol-forming substrate towards the mouth end of the smoking article.

18. The smoking article according to claim 15, wherein the first portion of the airflow pathway and the second portion of the airflow pathway are concentric.

19. The smoking article according to claim 15, wherein the first portion of the airflow pathway surrounds the second portion of the airflow pathway.

20. The smoking article according to claim 15, wherein the first portion of the airflow pathway and the second portion of the airflow pathway are of substantially constant transverse cross-section.

21. The smoking article according to claim 15, wherein the transverse cross-section of the first portion of the airflow pathway increases as the first portion of the airflow pathway extends upstream and a transverse cross-section of the second portion of the airflow pathway increases as the second portion of the airflow pathway extends downstream.

22. The smoking article according to claim 15, further comprising an airflow directing element downstream of the aerosol-forming substrate, the airflow directing element defining the first portion of the airflow pathway and the second portion of the airflow pathway.

23. The smoking article according to claim 22, wherein the airflow directing element comprises an open-ended, substantially air impermeable hollow body.

24. The smoking article according to claim 23, wherein the hollow body is a right circular cylinder.

25. The smoking article according to claim 23, wherein the hollow body is a truncated right circular cone.

26. The smoking article according to claim 15, wherein the blind heat source is a combustible heat source.

27. The smoking article according to claim 26, wherein the combustible heat source is a carbonaceous heat source.

28. The smoking article according to claim 26, wherein the combustible heat source is isolated from the airflow pathway such that air drawn along the airflow pathway does not directly contact the combustible heat source.

29. The smoking article according to claim 15, further comprising a heat-conducting element around and in contact with a rear portion of the heat source and a front portion of the aerosol-forming substrate.

30. A method of reducing or eliminating increases in temperature of an aerosol-forming substrate of a smoking article during puffing, the method comprising:

providing a smoking article, comprising:

a blind heat source;

an aerosol-forming substrate downstream of the heat source;

at least one air inlet downstream of the aerosol-forming substrate; and an airflow pathway extending between the at least one air inlet and the mouth end of the smoking article, wherein the airflow pathway comprises a first portion extending longitudinally upstream from the at least one air inlet towards the aerosol-forming substrate, and a second portion extending longitudinally downstream from the first portion towards the mouth end of the smoking article, wherein a transverse cross-section of the first portion of the airflow pathway increases as the first portion of the airflow pathway extends upstream; and drawing air into the smoking article through the at least one air inlet, the air passing upstream through the first portion of the airflow pathway towards the aerosol-forming substrate and then downstream towards the mouth end of the smoking article through the second portion of the airflow pathway.

* * * * *